US005435749A

United States Patent [19]

Kawase et al.

[11] Patent Number: 5,435,749

[45] Date of Patent: Jul. 25, 1995

[54] PANEL-FIXED TYPE CONNECTOR

[75] Inventors: Hajime Kawase; Kaoru Watanabe; Akira Nabeshima, all of Yokkaichi, Japan

[73] Assignee: Sumitomo Wiring Systems, Ltd., Japan

[21] Appl. No.: 196,421

[22] Filed: Feb. 15, 1994

[30] Foreign Application Priority Data

Feb. 17, 1993 [JP] Japan ..... 5-010916 U

[51] Int. Cl.[6] ..... H01R 13/74

[52] U.S. Cl. ..... 439/557

[58] Field of Search ..... 439/557, 353, 354, 357, 439/558

[56] References Cited

U.S. PATENT DOCUMENTS 4,609,119 9/1986 Richter, Sr. ..... 220/3.5

4,621,885 11/1986 Szczesny et al. ..... 439/357

FOREIGN PATENT DOCUMENTS 2315821 1/1977 France ..... 439/557

184677 11/1987 Japan .

143785 12/1990 Japan .

*Primary Examiner*—Gary F. Paumen

*Attorney, Agent, or Firm*—Jordan B. Bierman; Bierman and Muserlian

[57] ABSTRACT

This invention is directed to a panel-fixed connector which can be readily secured to a panel P and can maintain a stable attached position on the panel P. In the connector, when a lock member 5 is inserted into a clearance 16, a base plate 21 and an attaching piece 22 are inserted into the clearance 16 and an engaging protrusion 19 is engaged with an engaging aperture 30. When the connector is pushed into an attaching hole W in the panel P, a pawl 32 on a locking arm 25 is engaged with the hole W. Then, a slant face 33 of the pawl 32 is not injured by an edge E. Even if the locking arm 25 is deflected, a contacting piece 26 abuts on the base plate 21 thereby restraining a deflection of the arm 25 and preventing the lock member 5 from loosening in the clearance 16.

1 Claim, 5 Drawing Sheets

PANEL-FIXED TYPE CONNECTOR

BACKGROUND OF THE INVENTION

1. Field of the invention

This invention relates to a panel-fixed type connector which is secured to an attaching hole formed in a panel.

2. Statement of the Prior Art

For convenience of explanation, a conventional panel-fixed type connector will be explained below by referring to FIGS. 9 and 10. FIG. 9 is a longitudinal sectional view of a part of the prior panel-fixed type connector and FIG. 10 is an explanatory view illustrating a problem in the prior connector. As shown in FIG. 9, some of the prior panel-fixed type connectors are made of a plastic material.

A connector 50 shown in the drawings is a male connector or a so-called door-waiting connector which is secured to a panel P on a car body side or a door side in an automobile. The connector 50 is provided with a hood 51 which receives a female connector 60. The hood 51 is provided around a mouth edge with a flange 52. When an end of the hood 51 is inserted into an attaching hole W in the panel P, the flange 52 contacts with a peripheral edge of the hole W.

Also, the hood 51 is provided on an upper portion and a lower portion with a resilient locking arm 53 which has a pawl 54 at its distal end. When the end of the hood 51 is inserted into the attaching hole W, the locking arm 53 is inserted into the hole W while being deflected and the pawl 54 engages with the peripheral edge of the hole W. Thus, the connector 50 is secured to the panel P by a clamping action of the pawl 54 and flange 52. The pawl 54 has a slant face 55 which raises outwardly and rearwardly and a vertical face 56 which extends in parallel with the flange 52.

However, since the attaching hole W in the panel P is formed by a punching work, the mouth edge will become sharp and be provided with a burr. Consequently, upon attaching the connector to the panel, as shown in FIG. 10, the slant face 55 on the pawl 54 is damaged by the sharp edge E and the pawl 54 can not be readily engaged with the hole W.

Although the attaching hole W may be smoothly worked in order to overcome the problem, a working cost will be high. Further, in the case of forming the slant face 55 of the connector from a hard material such as a metal, the connector will become complicated in construction, large in size, and high in cost.

SUMMARY OF THE INVENTION

An object of the present invention is to provide a panel-fixed type connector which can overcome various problems caused by a slant face thereof made of a hard material.

In order to achieve the above object, a panel-fixed type connector of the present invention which mounts a hood of a connector body on an attaching hole in a panel, is characterized in that the hood is provided around a mouth edge thereof with an attaching portion for supporting a lock member made of a hard material; and the lock member includes a base plate, an attaching piece provided on an end of the base plate and adapted to be secured to the attaching portion, and a resilient locking arm having a pawl to be engaged with the attaching hole.

In the panel-fixed type connector, the attaching portion on the hood is formed by a clearance for receiving the base plate of the lock member and a lock protrusion in the clearance. The attaching piece of the lock member is folded on the base plate so as to be inserted into the clearance. An engaging aperture is formed in the attaching piece to receive the lock protrusion.

The attaching piece is provided with a contacting end which is directed to the base plate so that the end contacts with the plate. Thus, even if the locking arm is deflected by an external force, the lock member does not loosen in the clearance. A first bend portion which is folded inwardly at an obtuse angle and a second bend portion which is folded outwardly at an obtuse angle are formed between the base plate of the lock member and the locking arm. The locking arm is arranged in parallel with the base plate. Thus, the pawl on the locking arm does not extend outwardly from the base plate.

The locking arm of the lock member is provided with an outer limit piece which contacts with the attaching portion so that the outer limit piece restrains the arm from inclining outwardly.

It will be apparent from the foregoing that the panel-fixed connector of the present invention has a simple construction and the hood thereof can be easily attached to the panel since the lock member having the pawl to be engaged with the attaching hole in the panel is secured to the attaching portion formed around the mouth edge of the hood.

Figure 1:
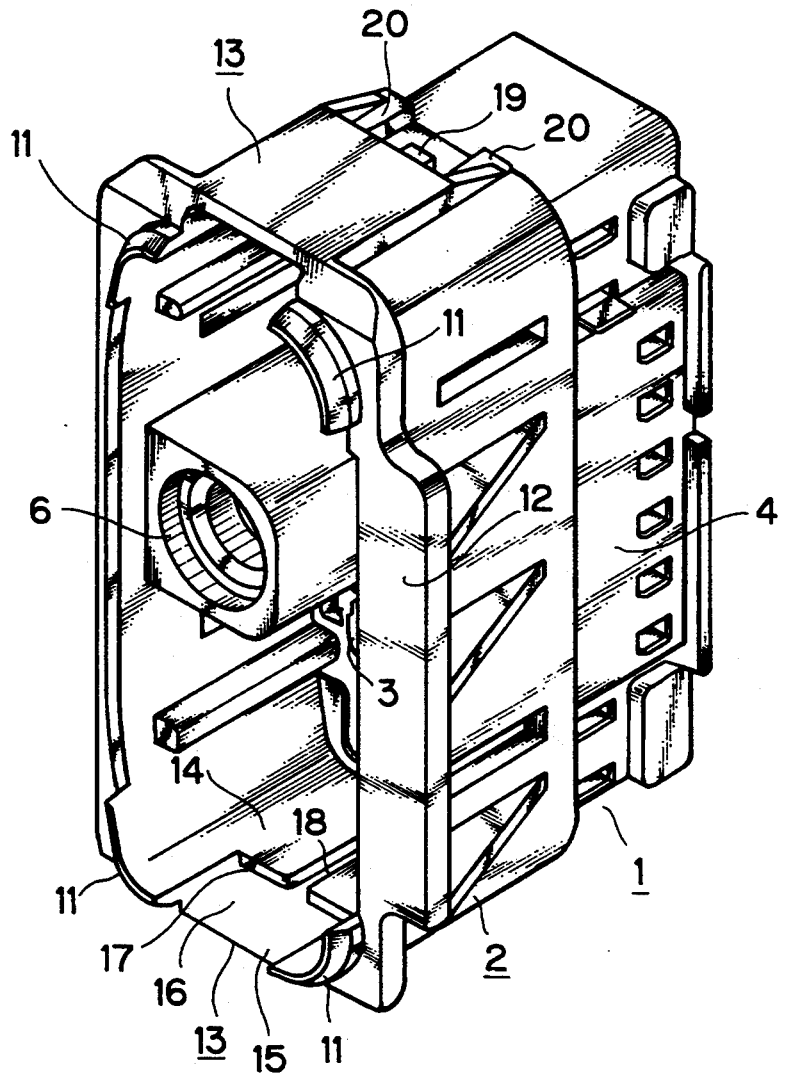
FIG. 1 is a perspective view of a connector body of a panel-fixed type connector of the present invention.

DETAILED DESCRIPTION OF THE PREFERRED EMBODIMENTS:

By referring to FIGS. 1 to 8, an embodiment of a panel-fixed type connector in accordance with the present invention will be explained below. The panel-fixed type connector is a male connector. A connector body 1 shown in FIG. 1 comprises a rectangular hood 2 which receives a female connector not shown and a projected portion 4 which has a plurality of terminal-accommodating apertures 3 at its bottom. A lock member 5 shown in FIG. 3 is attached to an attaching portion 13 of the hood 2. In this embodiment, the lock member 5 is made of a sheet of thin steel plate.

Figure 2:
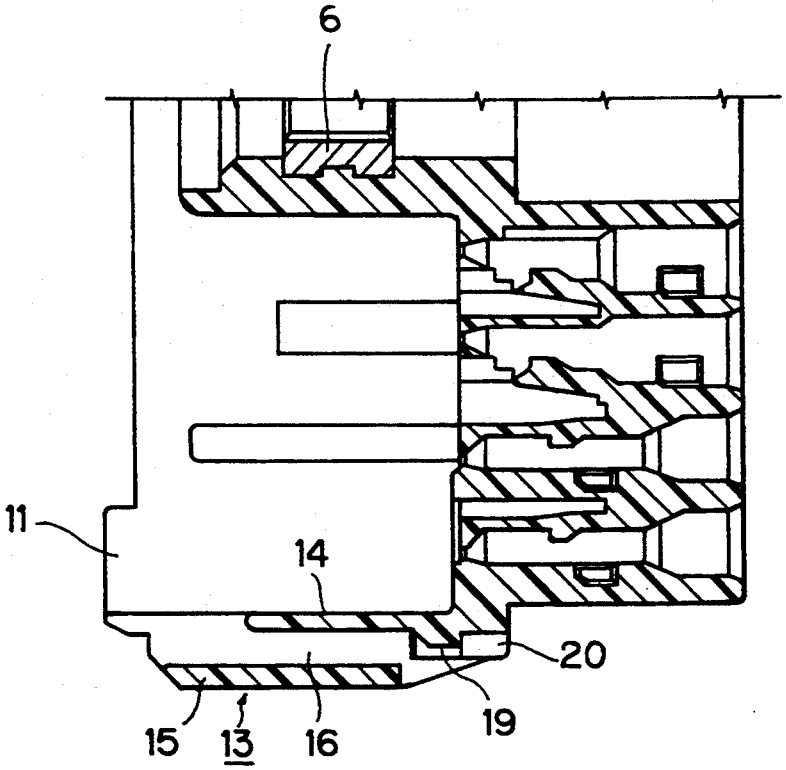
FIG. 2 is a longitudinal sectional view of a part of the connector body shown in FIG. 1.
Figure 3:
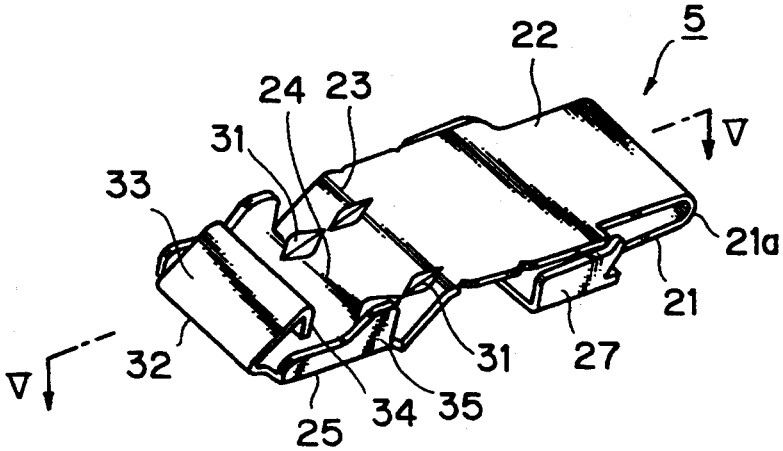
FIG. 3 is a perspective view of a lock member to be used in the connector of the present invention.

As shown in FIGS. 1 and 2, the hood 2 is provided on each corner on the mouth edge with a rib 11 which extends forwardly and on an entire periphery of the mouth with a flange 12. As described hereinafter, when the rib 11 is inserted into the attaching hole W in the panel P, the rib 11 serves to position the connector body 1 on the panel P and the flange 12 contacts with the rear side of the panel P.

Also, the hood 2 is provided on upper and lower faces with the attaching portion 13 which receives the lock member 5. The attaching portion 13 defines a rearward open flat clearance 16 by an inner wall 14 and an outer wall 15. The inner wall 14 which forms a part of an interior of the hood 2 is provided with an end face 17 cut at an intermediate portion in the hood 2 and a slit 18 extending forwardly along its center line. An engaging protrusion 19 is formed on the inner wall 14 in the clearance 16. Protrusions 20 are provided on opposite side walls at a proximal end in the clearance 16 so that the protrusions 20 make a width of the clearance 16 narrow, thereby preventing excessive insertion of the lock member into the clearance. The hood 2 is provided in the interior with a female screw portion 6 which engages with a male screw of the female connector not shown.

Figure 4:
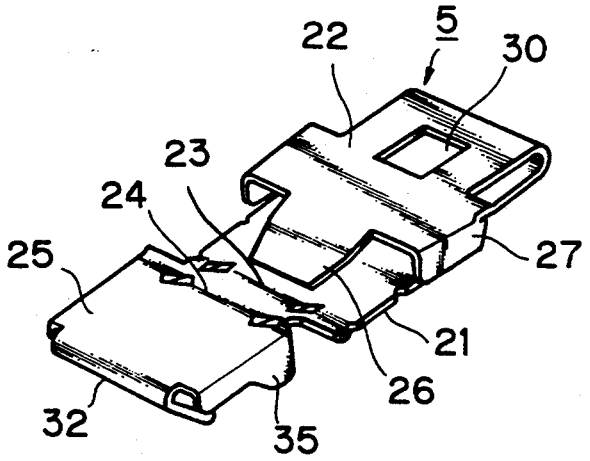
FIG. 4 is a perspective view taken from a rear side of the lock member shown in FIG. 3.
Figure 5:
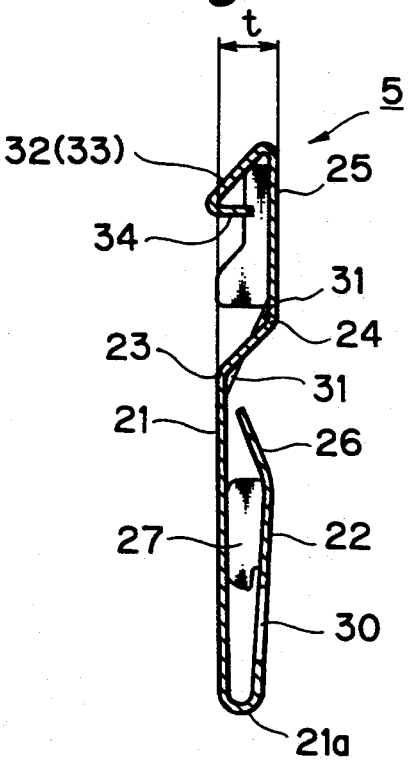
FIG. 5 is a longitudinal sectional view taken along lines V—V in FIG. 3.

The lock member 5, as shown in FIGS. 3 and 4, includes a center base plate 21, and an attaching piece 22 which is formed by folding an end of the plate 21 inwardly at a turning portion 21*a*. The lock member 5 can be inserted into the clearance 16 while deflecting the turning portion 21*a*. The lock member 5 also includes a locking arm 25 parallel to the base plate 21. The locking arm 25 has a first bend portion 23 bent inwardly at the other end of the base plate 21 by an angle of about 135° and a second bend portion 24 bent outwardly at an end of the first bend portion 23 by an angle of about 135°. The first and second bend portions 23 and 24 are provided with reinforcing protrusions 31 by punching, thereby maintaining the angles of the portions 23 and 24. The lock member 5 has a thickness t (FIG. 5) equal to a gap of the clearance 16 plus a thickness of the inner wall 14 so that the lock member 5 can be inserted into the clearance 16.

A contacting piece 26 (FIG. 4) is formed by bending inwardly an end of the attaching piece 22 so that the piece 26 can contact with the rear side of the base plate 21 by means of deflection at the turning portion 21*a* upon inserting the member 5. That is, when the contacting piece 26 abuts on the base plate 21, the base plate 21, turning portion 21*a*, attaching piece 22, and contacting piece 26 define an O-shaped space having a thickness equal to the thickness t of the lock member, thereby restraining an excessive deflection of the turning portion 21*a*, when a large force such as a force necessary to insert the lock member 5 into the clearance 16 is applied to the attaching piece 22, the contacting piece 26 can be deflected. An engaging aperture 30 is formed in a center of the attaching piece 22 so that the engaging protrusion 19 engages with the aperture 30 upon inserting the lock member 5 into the clearance 16, thereby securing the lock member 5 in the clearance 16. Further, the attaching piece 22 is provided on opposite sides with resisting pieces 27 which are bent outwardly and serve to prevent an excessive insertion of the lock member 5. The resisting pieces 27 contact with the protrusions 20 so as to restrain the excessive insertion of the lock member 5 when it is inserted into the clearance 16.

On the other hand, the locking arm 25 is provided at an end with a triangular pawl 32 bent outwardly. The pawl has a slant face 33 which inclines rearwardly and a vertical face 34 perpendicular to the locking arm 25. When the lock member 5 is inserted into the attaching hole W in the panel P, the slant face 33 slides on the edge of the hole W while deflecting the locking arm 25, thereby enabling the lock member 5 to be inserted into the hole W. After inserting, the vertical face 34 engages with the edge of the hole W by an elastic force of the locking arm. The locking arm 25 is provided on the opposite sides with outer limit pieces 35, ends of which extend to the same plane as the outer face of the base plate 21.

Next, an operation of the embodiment constructed above will be explained below.

Figure 6:
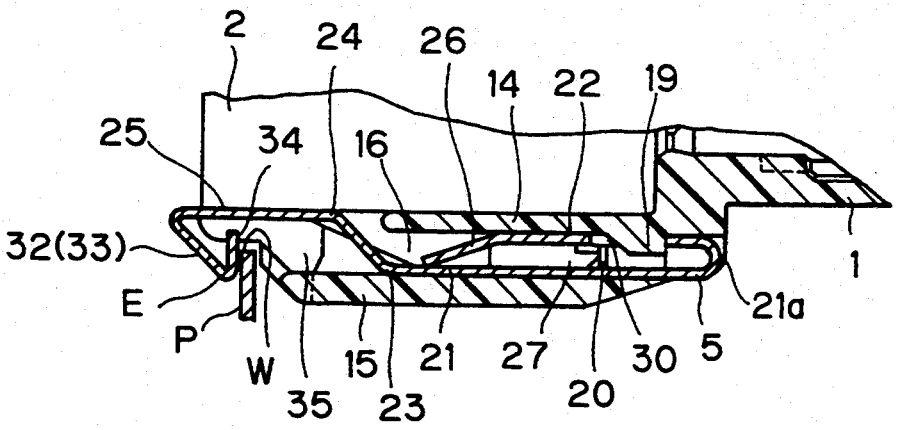
FIG. 6 is a fragmentary longitudinal sectional view of the connector, illustrating the lock member accommodated in the connector body.

In order to attach the lock member to the connector body 1, as shown in FIG. 6, the attaching piece 22 of the lock member 5 is inserted into the clearance 16. Then, the turning portion 21*a* is inserted into the clearance while deflecting and the contacting piece 26 slides over the engaging protrusion 19 while deflecting, even if the piece 26 abuts on the protrusion 19. As shown in FIG. 6, the engaging protrusion 19 engages with the engaging aperture 30, the resisting protrusions 27 abuts on the protrusion 20, and the lock member 5 is held at this position in the clearance 16.

When attaching the lock member 5 in the clearance 16, the base plate 21 is pushed onto the outer wall by means of a spring action of the turning portion 21*a* and the locking arm 25 is arranged in parallel with the base plate 21. Since the thickness t of the lock member 5 is equal to the gap of the clearance 16 plus the thickness of the inner wall 14, the locking arm 25 is fixed on the panel without projecting into the hood 2 and does not interfere an insertion of the female connector not shown when it is inserted into the hood 2.

Figure 7:
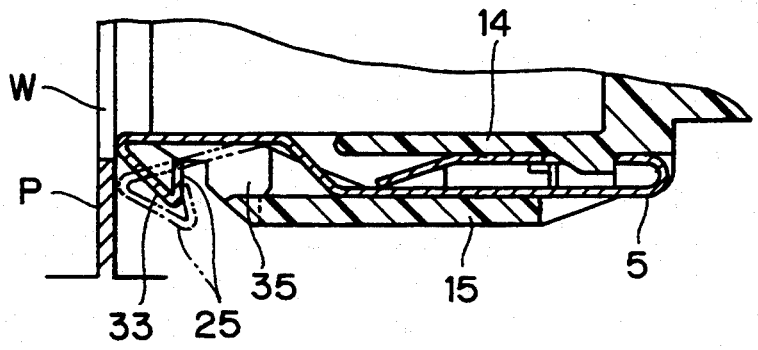
FIG. 7 is a similar view to FIG. 6, but illustrating the lock member being restrained from its movement.
Figure 8:
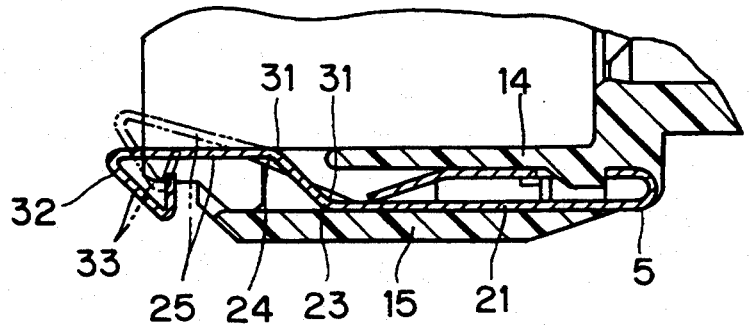
FIG. 8 is another similar view to FIG. 6, but illustrating the lock member being restrained from its movement.
Figure 9:
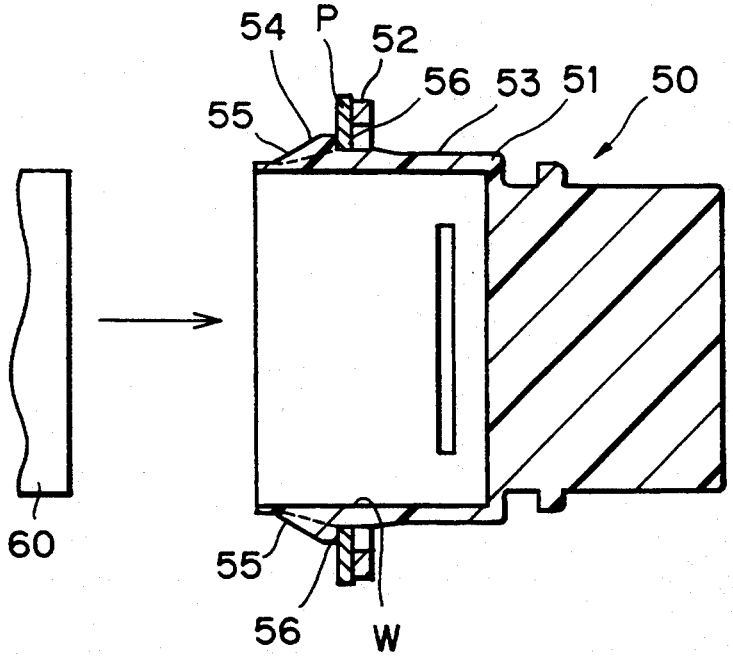
Fig. 9 Prior Art
FIG. 9 is a longitudinal sectional view of a part of a conventional panel-fixed type connector.
Figure 10:
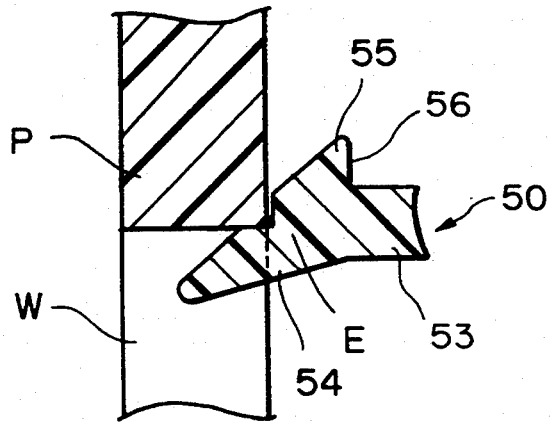
Fig. 10 Prior Art
FIG. 10 is an explanatory view illustrating a problem in the connector shown in FIG. 9.

Also, since the outer limit piece 35 is provided in this embodiment and the locking arm 25 is prevented from deflecting outwardly by means of the outer wall 15, there is no problem in which the locking arm 25 is outwardly deflected to a position shown by a two-dot chain line in FIG. 7 so that an end of the pawl 32 abuts on the peripheral edge of the attaching hole W when attaching the lock member 5 to the panel P, thereby enabling the member 5 not to be inserted into the clearance 16. Accordingly, the lock member 5 is attached to the panel P with the slant face 33 always abutting on the edge E.

Adversely, since the first and second bend portions 23 and 24 are reinforced by projections 31 so that the locking arm 25 is not deflected inwardly and the pawl 32 does not lose a sufficient force to engage with the panel P, the locking arm 25 is secured to the panel P in parallel with the base plate 21.

Thus, in order to attach the connector body 1 which accommodates the lock member 5 to the attaching hole W, the connector body 1 is positioned so that the ribs 11 (FIG. 1) on the mouth edge of the hood 2 can be inserted into the attaching hole W from the rear side of the panel P and the body 1 is pushed into the hole W until the flange 12 contacts with the rear side of the panel P. Then, as shown in FIG. 6, the locking arm 25 is inserted into the hole W while the slant face 33 of the pawl 32 slides on the mouth edge of the attaching hole W and the mouth edge deflects the arm 25. An elastic force of the locking arm 25 pushes the vertical face 34 onto the front side of the panel P and the flange 12 (FIG. 1) and the vertical face 34 clamp the panel P at its front and rear sides.

When the pawl 32 is inserted into the attaching hole W, a rearward force is applied to the slant face 33, thereby applying a vertical component of force to the lock member 5. Consequently, the lock member 5 is further pushed into the clearance 16, but the lock member is not inserted excessively into the clearance 16 but held at a given position in the clearance by an engagement of the protrusions 20 and 27.

Since the vertical component of force deflects inwardly not only the locking arm 25 but also the base plate 21 from the turning portion 21*a*, the base plate 21 does not loosen in the clearance 16. However, since the contacting piece 26 abuts on the base plate 21, the locking arm 25 deflects from a contact point of the contacting piece on the base plate 21 and the lock member 5 is secured to the attaching portion 13 without loosening the member 5 therein. This can obtain a larger elastic force than a construction in which the turning portion 21*a* is a supporting point.

After attaching the connector to the attaching hole W, the connector is hardly detached from the attaching hole W and is steadily secured to the hole W by the following reasons even if any external force is applied to the pawl 32 to inwardly deflect the pawl 32:

(b 1) a force caused by a spring action of the turning portion 21*a* pushes the base plate 21 onto the outer wall 15;

(2) a stiffness of the locking arm 25 is enhanced by the reinforcing projection 31; and (3) the contacting piece 26 supports the base plate 21 when the locking arm 25 deflects inwardly.

As described above, since the lock member 5 is made of a sheet of thin steel plate in the above embodiment, although the lock member 5 is separated from the connector body 1, the lock member 5 can be easily formed. The lock protrusion 19 engages with the engaging aperture 30 so as to attach the lock member 5 to the attaching portion 13 merely by pushing the member 5 to the portion 13. Further, it is possible to attach the connector to the panel P merely by pushing the connector into the attaching hole W and to generate a force large enough to hold the connector in the attaching hole W.

Although the lock member 5 is made of a sheet of thin steel plate in the above embodiment, it may be made of a hard plastic material.

Although the connector body 1 is provided on both sides with the lock member 5 in the above embodiment, a rigid pawl is formed together on one side of the connector body 1 and the lock member 5 is formed on the other side of the body 1. The present invention should not be limited to the above embodiment and can be carried out within a scope without changing the gist of the invention.

What is claimed is:

1. A panel-fixed type connector for mounting a hood of a connector body in an attaching hole of a panel, said hood being provided with an attaching portion for supporting a lock member formed of a hard material, said attaching portion being adapted to engage a mouth edge of said attaching hole;

said lock member including a base plate, an attaching piece provided on an end of said base plate, said attaching piece being adapted to be secured to said attaching portion, and a resilient locking arm having a pawl for engaging said attaching hole;

said attaching portion on said hood being formed as a clearance for receiving said base plate of said lock member, a lock protrusion being provided in said clearance, wherein said attaching piece of said lock member is folded on said base plate to be inserted into said clearance, and an engaging aperture is formed in said attaching piece to receive said lock protrusion;

said attaching piece being provided with a contacting end directed to said base plate whereby said contacting end contacts said plate.

* * * * *